US008269705B2

(12) United States Patent
Kim et al.

(10) Patent No.: US 8,269,705 B2
(45) Date of Patent: Sep. 18, 2012

(54) LIQUID CRYSTAL DISPLAY AND DRIVING METHOD THEREOF

(75) Inventors: Yun-nam Kim, Suwon-si (KR); Yeun-mo Yeon, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 1086 days.

(21) Appl. No.: 12/181,162

(22) Filed: Jul. 28, 2008

(65) Prior Publication Data

US 2009/0167659 A1 Jul. 2, 2009

(30) Foreign Application Priority Data

Jan. 2, 2008 (KR) ..... 10-2008-0000250

(51) Int. Cl.
*G09G 3/36* (2006.01)

(52) U.S. Cl. ..... 345/89; 345/87; 345/589

(58) Field of Classification Search ..... 345/89, 345/94

See application file for complete search history.

(56) References Cited

U.S. PATENT DOCUMENTS

| | | | | |
|---|---|---|---|---|
| 6,633,271 | B1 | 10/2003 | Motegi et al. | |
| 7,095,396 | B2 * | 8/2006 | Ohta et al. | 345/94 |
| 2004/0169627 | A1 * | 9/2004 | Hong | 345/89 |
| 2006/0007091 | A1 * | 1/2006 | Yang et al. | 345/89 |

FOREIGN PATENT DOCUMENTS

| | | | |
|---|---|---|---|
| JP | 06-222328 | | 8/1994 |
| JP | 11-003061 | | 1/1999 |
| JP | 11194318 | | 7/1999 |
| KR | 1020040013536 | | 2/2004 |
| KR | 1020040053641 | | 6/2004 |
| KR | 10-2004-0063366 | * | 7/2004 |
| KR | 1020040063366 | | 7/2004 |
| KR | 100527089 | | 11/2005 |
| KR | 1020060011352 | | 2/2006 |
| KR | 100701084 | | 3/2007 |

* cited by examiner

*Primary Examiner* — Quan-Zhen Wang
*Assistant Examiner* — Troy Dalrymple
(74) *Attorney, Agent, or Firm* — Innovation Counsel LLP

(57) ABSTRACT

A liquid crystal display including a plurality of pixels includes a gray voltage generator generating a plurality of gray voltages, a data driver supplying data voltages selected from the gray voltages corresponding to image data to the pixels, a gate driver supplying gate voltages to gate lines of the pixels, a signal controller supplying a first control signal to the gate driver and the image data and a second control signal to the data driver for controlling the image data and comprising a dimming controller, the dimming controller generating a dimming signal based on an average gray of the image data over at least one frame and a common voltage generator generating at least one common voltage based on the dimming signal and applying the common voltage to the pixels. Therefore, the variation of the pixel voltage depending on the gray of the image data is decreased to improve image quality of the LCD.

9 Claims, 7 Drawing Sheets

LIQUID CRYSTAL DISPLAY AND DRIVING METHOD THEREOF

This application claims priority to Korean Patent Application No. 10-2008-0000250 filed on Jan. 2, 2007 and all the benefits accruing therefrom under 35 U.S.C. §119, and the contents of which in its entirety are herein incorporated by reference.

BACKGROUND OF THE INVENTION (a) Field of the Invention

The present invention relates to a liquid crystal display device and a driving method thereof and, more particularly, to a liquid crystal display device and driving method thereof capable of improving display quality.

(b) Description of the Related Art

Liquid crystal displays (LCDs) include two panels having pixel electrodes and common electrode and a liquid crystal (LC) layer with dielectric anisotropy, which is interposed between the two panels. The pixel electrodes are arranged in a matrix type and connected to switching elements such as thin film transistors (TFTs). The switching elements selectively transmit data voltages from data lines in response to gate signals from gate lines to the pixel electrode. The common electrode is formed on one surface of one of the two panels and is supplied with a common voltage. The pixel electrode, the common electrode and the LC layer form a LC capacitor in circuital view, which is a basic element of a pixel along with the switching element connected thereto.

In the LCD, voltages are applied to the two electrodes to generate an electric field in the LC layer, and the transmittance of light passing through the LC layer is adjusted by controlling the strength of the electric field, thereby obtaining desired images. In order to prevent image deterioration due to a long-time application of the unidirectional electric field, polarity of data voltages with respect to the common voltage is reversed every frame, every raw or every dot.

However, the polarity inversion is one cause of a flicker phenomenon. The flicker phenomenon is due to a kickback voltage, which is generated due to the characteristic of the switching element. That is, a pixel voltage across the LC capacitor is decreased by an amount of the kickback voltage, thereby generating the flicker phenomenon.

The kickback voltage varies depending on the position on an LCD panel. In particular, the variation of the kickback voltage is large along a row direction, i.e., an extending direction of the gate lines. It is because the difference between a gate-on voltage and a gate-off voltage, which determines the value of the kickback voltage, changes along the gate line due to the delay of the gate signals. In more detail, the kickback voltage is the largest at a position where the gate signals are first applied. However, since the drop rate of the gate-on voltage becomes smaller as it goes away from the application point along the gate lines, the kickback voltage is decreased.

Therefore, it is suggested that a plurality of common voltages with different values should be supplied to the electrodes of different positions on an LCD panel to compensate the delay of the gate signals.

Meanwhile, because a LC material has dielectric anisotropy, the dielectric constant of the LC material varies depending on a tiled direction. The LC director of the LC layer in the LC capacitor is changed depending on the strength of the electric field, which in turn changes the dielectric constant of the LC layer. The change of the dielectric constant causes a change in the capacitance of the LC capacitor. Since the value of the kickback voltage depends on the capacitance of the LC capacitor, it is changed depending on the capacitance change of the LC capacitor.

However, the conventional technology applies the common voltages depending on the position on the LC panel assembly without considering the dependency of the kickback voltage on the data voltages, which does not remove the flicker phenomenon.

BRIEF SUMMARY OF THE INVENTION

Exemplary embodiments of the present invention provide a liquid crystal display device and a driving method thereof and, more particularly, to a liquid crystal display device and driving method thereof capable of improving display quality.

This as well as other features and advantages of the present invention will become clear to those skilled in the art upon review of the following description.

According to exemplary embodiments of the present invention, there is provided a liquid crystal display including a plurality of pixels arranged in a matrix, which includes a gray voltage generator generating a plurality of gray voltages, a data driver supplying data voltages selected from the gray voltages according to image data to the pixels, a gate driver supplying gate voltages to gate lines of the pixels, a signal controller supplying a first control signal to the gate driver and the image data and a second control signal for controlling the image data to the data driver, the signal controller comprising a dimming controller generating a dimming signal, the dimming controller having a frame memory and an average gray calculator calculating an average gray of the image data over one frame connected to the frame memory, and a common voltage generator generating at least one common voltage based on the average gray of the image data and applying the generated voltage to at least one common voltage to the pixels.

The at least one common voltage becomes as high in magnitude as the average gray of the image data becomes larger.

The dimming controller can comprise a frame memory storing the image data R, G and B for at least one frame.

The average gray calculator may be connected to the frame memory.

The average gray calculator generates a pulse width modulation (PWM) dimming signal having a variable duty ratio by comparing a value of the average gray with a gray reference value, for example, the PWM dimming signal has high duty ratio if the value of the average gray is higher than the gray reference value and the PWM dimming signal has low duty ratio if the value of the average gray is lower than the gray reference value.

A variation of the at least one common voltage is proportional to a variation of a kickback voltage or the average gray of the image data.

The common voltage generator may include a dimming signal converter receiving the dimming signal and generating a gray luminance voltage by integrating the dimming signal.

The dimming signal converter may be an NPN type bipolar transistor.

The common voltage generator can includes a variable common reference voltage converter receiving a gray luminance voltage from the dimming signal converter and an input reference voltage externally input and output at least one common reference voltage.

The variable common reference voltage converter may include a negative feedback inverting amplifier.

The common voltage generator can include a variable common voltage generator having at least one negative feedback inverting amplifier including an inverting terminal receiving a feedback voltage for the common voltage applied to the pixels via a resistor, a non-inverting terminal receiving the at least common reference voltage and an output terminal outputting at least the common voltage.

According to other exemplary embodiments of the present invention, there is provided a method of driving a liquid crystal display device. An exemplary embodiment of the driving method of the LCD device includes the steps of creating of a dimming signal by operating image data during a frame, creating a gray luminance voltage by using a duty ratio of the dimming signal, generating a common reference voltage by adding the input reference voltage and gray luminance, and outputting a common voltage to the LCD panel.

BRIEF DESCRIPTION OF THE DRAWINGS

The above and other advantages of the present invention will become more apparently by describing preferred embodiments thereof in detail with reference to the accompanying drawings in which.

DETAILED DESCRIPTION OF PREFERRED EMBODIMENTS

Figure 1:
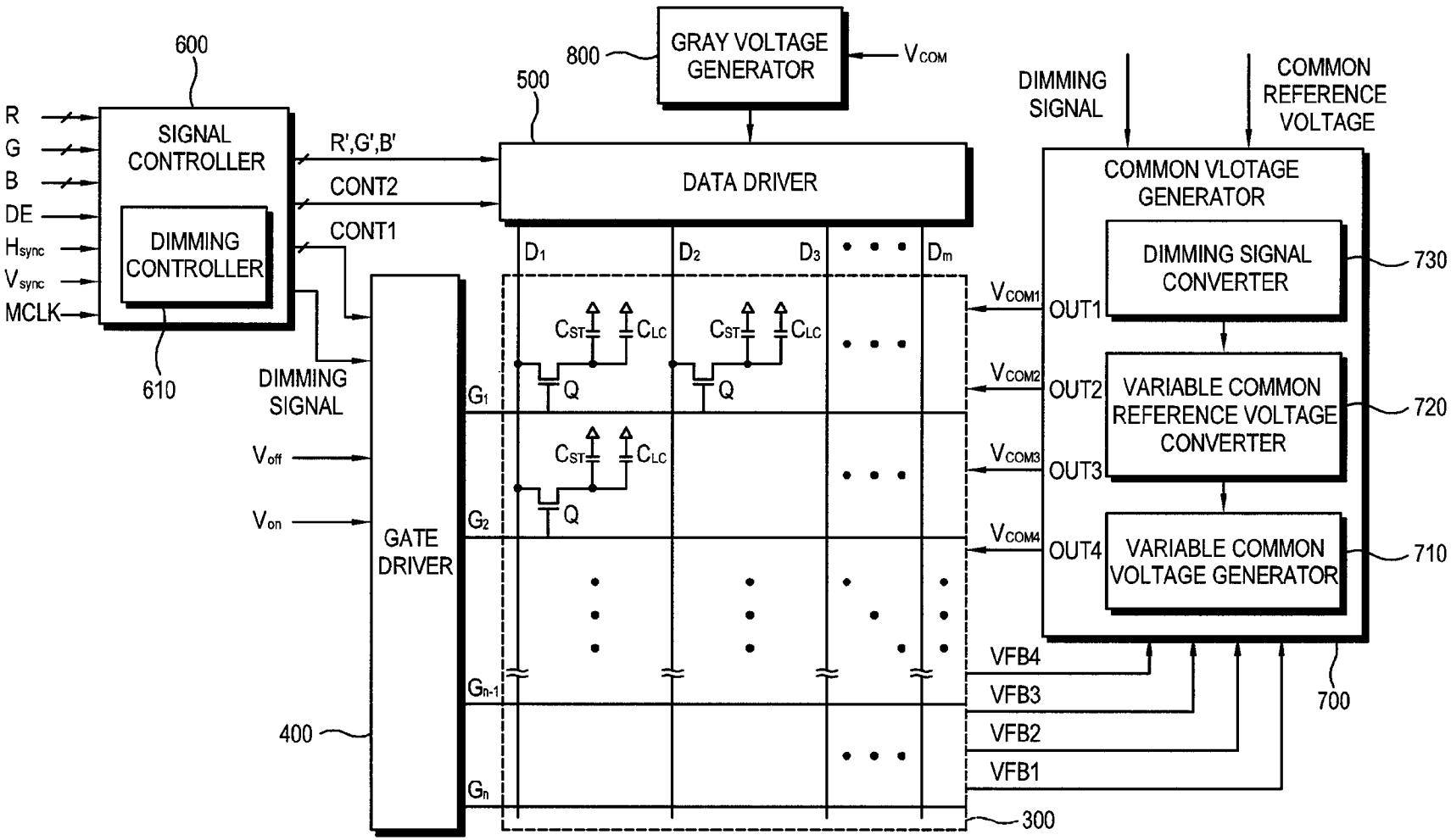
FIG. 1 is a block diagram schematically illustrating an exemplary embodiment of an LCD device according to the present invention.

The invention now will be described more fully hereinafter with reference to the accompanying drawings, in which preferred embodiments of the invention are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

In the drawings, the thickness of layers and regions are exaggerated for clarity. It will be understood that when an element such as a component in an electric circuit is referred to as being "connected to" another element, it can be directly connected to the other element or intervening elements may also be present. In contrast, when an element is referred to as being "directly connected to" another element, there are no intervening elements present.

Hereinafter, the present invention will be described in detail with reference to the accompanying drawings.

Figure 2:
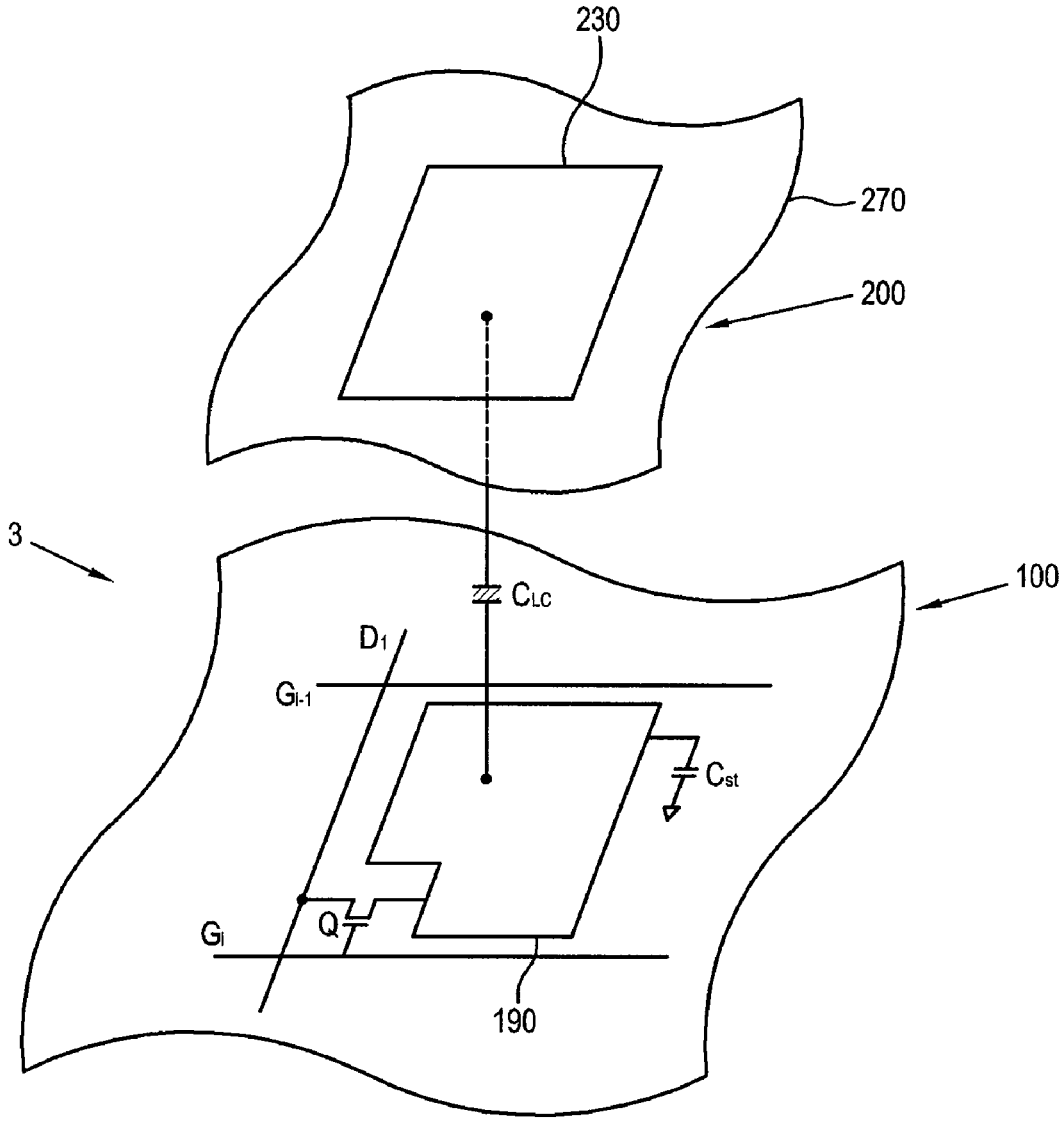
FIG. 2 is an equivalent circuit diagram of a pixel of an LCD device.

FIG. 1 is a block diagram schematically illustrating an exemplary embodiment of an LCD device, and FIG. 2 is an equivalent circuit diagram of a pixel of an LCD according to an embodiment of the present invention.

Referring to FIG. 1, an LCD according to an embodiment of the present invention includes an LC panel assembly 300, a gate driver 400 and a data driver 500 which are connected to the panel assembly 300, a gray voltage generator 800 connected to the data driver 500, a common voltage generator 700 connected to the LC panel assembly 300, and a signal controller 600 controlling the above elements.

The panel assembly 300 includes a plurality of display signal lines $G_1$-$G_n$ and $D_1$-$D_m$ and a plurality of pixels connected thereto and arranged substantially in a matrix.

The display signal lines $G_1$-$G_n$ and $D_1$-$D_m$ include a plurality of gate lines $G_1$-$G_n$ transmitting gate signals (also referred to as "scanning signals"), and a plurality of data lines $D_1$-$D_m$ transmitting data signals. The gate liens $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$ and a LC capacitor and a storage capacitor $C_{ST}$ that are connected to the switching element Q. If necessary, the storage capacitor $C_{ST}$ may be omitted.

The switching element Q is provided on a lower panel 100 and has three terminals, a control terminal connected to one of the gate lines $G_1$-$G_n$, and an input terminal connected to one of the data lines $D_1$-$D_n$, and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as a dielectric of the LC capacitor $C_{LC}$.

The pixel electrode 190 is connected to the switching element Q and the common electrode 270 is connected to the common voltage $V_{com}$ and covers the entire surface of the upper panel 200. Unlike FIG. 2, the common electrode 270 may be provided on the lower panel 100, and both electrode 190 and 270 have a bar or stripe shape.

The storage capacitor $C_{ST}$ is defined by the overlap of the pixel electrode 190 and a separate wire (not shown) provided on the lower panel 100 and applied with a predetermined voltage such as the common voltage $V_{com}$. Otherwise, the storage capacitor $C_{ST}$ may be defined by the overlap of the pixel electrode 190 and its previous gate line $G_{i-1}$ via an insulator.

For color displays, each pixel can represent its own color by providing one of a plurality of red, green and blue color filters 230 in an area corresponding to the pixel electrode 190. The color filters 230 shown in FIG. 2 are provided in the corresponding area of the upper panel 200. Alternatively, the color filters 230 are provided on or under the pixel electrode 190 on the lower panel 100.

The LC molecules in the LC capacitor CLC have orientations depending on the variation of electric field generated by the pixel electrode 190 and the common electrode 270, and the molecular orientations determine the polarization of light passing through the LC layer 3. A polarizer or polarizers (not shown) attached to at least one of the panel 100 and 200 convert the light polarization to light transmittance such that a pixel has a luminance proportional to a level of the analog data voltage applied to the pixel, e.g., the pixel voltage.

Referring to FIG. 1 again, the gray voltage generator 800 generates two sets of a plurality of gray voltage related to the transmittance of the pixels. The gray voltages in one set have a positive polarity with respect to the common voltage $V_{com}$, while those in the other set have a negative polarity with respect to the common voltage $V_{com}$.

The gate driver 400 is connected to the gate lines $G_1$-$G_n$ of the panel assembly 300 and applies gate signals from an external device to the gate lines $G_1$-$G_n$, each gate signal being a combination of a gate-on voltage $V_{on}$ and a gate-off voltage $V_{off}$.

The data driver 500 is connected to the data lines D1-Dm of the panel assembly 300 and selects gray voltages from the gray voltage generator 800 to apply as data signals to the data line $D_1$-$D_m$.

The common voltage generator 700 is connected to the common electrode 270 of the LC panel assembly 300 and generates a plurality of variable common voltage, for example, four variable common voltages $V_{com1}$-$V_{com4}$ to be applied to respective positions of the common electrode 270 provided on the LC panel assembly 300. The value of each variable common voltage $V_{com1}$-$V_{com4}$ is defined by the image signal R, B and B.

The signal controller 600 generates control signals for controlling the gate driver 400, the data driver 500 and the common voltage generator 700.

The signal controller 600 is supplied from an external graphic controller (not shown) with RGB image signal R, G and B and input control signals controlling the display thereof, for example, a vertical synchronization signal $V_{sync}$, a horizontal synchronization signal $H_{sync}$, a main clock CLK, a data enable signal DE, etc. The signal controller 600 generates a plurality of gate control signals CONT1, a plurality of data control signals CONT2, and a dimming signal and processes the image data R, G and B for the LC panel assembly 300 on the basis of the input control signals. The signal controller 600 provides the gate control signals CONT1 for the gate driver 400, the data control signals CONT2 and the processed image data R', G' and B' for the data driver 500, and the dimming signal for the common voltage generator 700. The signal controller 600 includes a dimming controller 610 sequentially supplied with image data R, G and B from an external device and calculating the average gray of the image data R, G and B for one frame. The dimming controller 610 generates the dimming signal based on the average gray of the image data R, G and B to the common voltage generator 700. The dimming controller 610 will later be described in greater detail with reference to FIG. 3.

The gate control signals CONT1 include a vertical synchronization start signal STV to indicate the start of a frame, a gate clock signal CPV for controlling the output time of the gate-on voltage $V_{on}$ and an output enable signal OE for defining the widths of the gate-on voltage $V_{on}$.

The data control signals CONT2 include a horizontal synchronization start signal STH for indicating the start of a horizontal period, a load signal LOAD or TP for instructing to apply the appropriate data voltages to the data lines $D_1$-$D_m$, an inversion control signal RVS for reversing the polarity of the data voltages (with respect to the common voltage $V_{com}$) and a data clock signal HCLK.

The common voltage generator 700 adjusts the values of a plurality of common voltages $V_{com1}$-$V_{com4}$ based on the dimming signal and applies the adjusted common voltages $V_{com1}$-$V_{com4}$ to respective positions of the common electrode 270. The common voltage generator 700 will later be described in greater detail with reference to FIGS. 4 to 5.

The gray voltage generator 800 generates a plurality of gray voltages related to the transmittance of the pixels to the data driver (500). The plurality of gray voltages may be two sets of a plurality of gray voltages.

The data driver 500 receives a packet of the image data R', G' and B' for a pixel row from the signal controller 600 and coverts the image data R', G' and B' into analogue data voltages selected from the gray voltages from the gray voltage generator 570 to change the image data R', G' and B' in response to the data control signals CONT2 from the signal controller 600.

The data driver 500 applies the data voltage to the corresponding data line D during a turn-on time of the switching elements Q due to the application of the gate-on voltage V to gate lines G connected to the switching elements Q (which is called "one horizontal period" or "1H" and is equal to one period of the horizontal synchronization signal H, the data enable signal DE and the data clock signal CPV). Then, the data voltages in turn are supplied to the corresponding pixels via the turned-on switching elements Q.

Responsive to the gate control signals CONT1 from the signal controller 600, the gate driver 400 applies the gate-on voltage $V_{on}$ to the gate line $G_1$-$G_n$, thereby turning on the switching elements Q connected thereto.

By repeating this procedure, all gate lines G are sequentially supplied with the gate-on voltage V during a frame, thereby applying the data voltages to all pixels. When the next frame starts after finishing one frame, the inversion control RVS applied to the data driver 500 is controlled such that the polarity of the data voltage is reversed (which is called "inversion driving"). The inversion control signal RVS may be also controlled such that the polarity of the data voltages flowing in a data line in one frame is reversed (which is called "line inversion") or the polarity of the data voltages in one packet is reversed (which is called "dot inversion").

Figure 3:
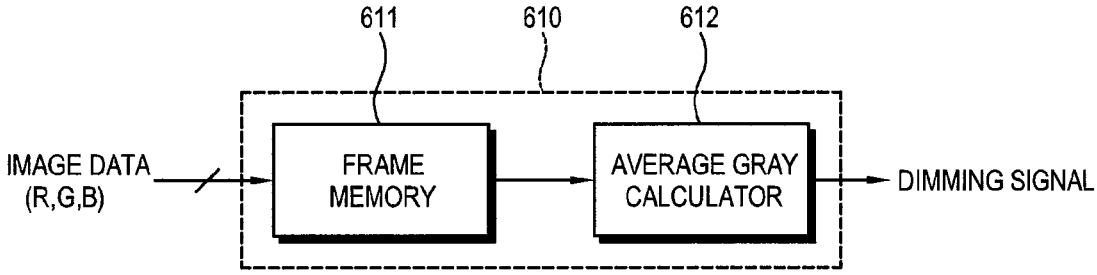
FIG. 3 is a block diagram schematically illustrating an exemplary embodiment of a dimming controller of an exemplary embodiment of an LCD device illustrated in FIG. 1.

Next, the dimming signal that the dimming controller 610 generates based on image data of a frame according to an exemplary embodiment of the present invention will be described in detail with reference FIG. 3. FIG. 3 is a block diagram of an exemplary dimming controller according to an embodiment of the present invention.

As shown in FIG. 3, a dimming controller 610 included in the signal controller (600) according to this embodiment includes a frame memory 611 for storing the image data R, G and B from an external device and an average gray calculator 612 connected to the frame memory 611.

In an exemplary embodiment the frame memory 611 stores image data during at least one frame and supplies the stored value to the average gray calculator 612. The image data R, G and B may be directly received from an external device or may be received through the signal controller 600. When the image data R, G and B for one frame are stored into the frame memory 611, the average gray calculator 612 calculates the average gray of the image data R, G and B for one frame and supplies a dimming signal corresponding to the average gray of the image R, G and B for one frame to a dimming signal converter 730. The dimming signal may be a pulse width modulation ("PWM") signal with a duty ratio. The dimming signal comprises a pulse width modulation (PWM) dimming signal having a variable duty ratio according to a comparison of a value of the average gray with a gray reference value. The average gray calculator 612 calculates between the average gray of the image data and a reference gray, and outputs the dimming signals, which are used to output a gray luminance voltage for a dimming signal converter 730. The PWM dimming signal has a high duty ratio if the value of the average gray is higher than the gray reference value or the PWM dimming signal has a low duty ratio if the value of the average gray is lower than the gray reference value. The higher is the average gray, the higher is the duty ratio of the PWM dimming signal. Alternatively, in an exemplary embodiment the dimming signal may be a DC voltage of a high or low level.

Next, the voltage adjustment of a plurality of common voltages based on a dimming signal according to an embodiment of the present invention will be described in detail with reference to FIGS. 4 to 5.

Figure 4:
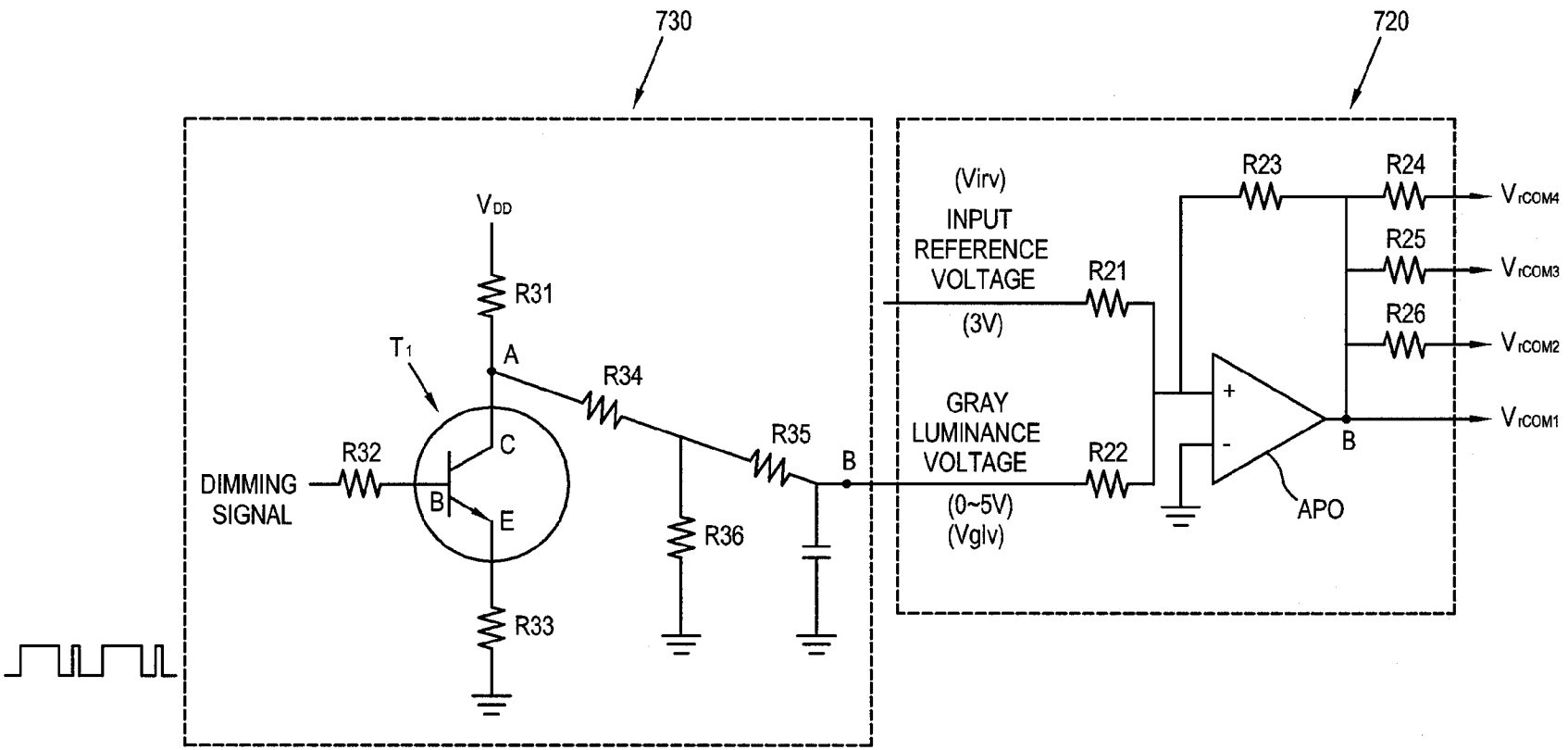
FIG. 4 is an equivalent circuit illustrating an exemplary embodiment of a dimming signal converter and a variable common reference voltage converter of an exemplary embodiment of a common voltage generator illustrated in FIG. 1.

FIG. 4 is an equivalent circuit illustrating an exemplary embodiment of a dimming signal converter 730 and a common reference voltage converter 720 of an exemplary embodiment of the common voltage generator 700 illustrated in FIG. 1. As shown in FIG. 4, the dimming signal converter 730 includes a transistor T1. The transistor T1 comprises a base electrode connected to the dimming controller 610 through a resistor R32 for receiving the dimming signal, a emitter electrode connected to a ground through a resistor R33, and a collector electrode connected to a supply voltage VDD through a resistor R31 and a node A. The resistor R31 may have a large resistance to decrease the supply voltage VDD and supply a low voltage to the node A. In this exemplary embodiment, the transistor T1 is a transistor of NPN type. In an exemplary embodiment, the transistor T1 may be substituted by a transistor of PNP type or OP AMP (operational amplifier; OP AMP), and so on. There are resistors R34 and R35 connected in series and a resistor R36 between the node A and a node B. current by the transistor T1 is adjusted according to the duty ratio, and then the lever of the gray luminance voltage (Vglv) output to the variable common reference voltage converter 720 is controlled. That is, a signal input as pulse by the dimming signal converter 730 is integrated and converted to a direct current voltage having a constant level.

Figure 6:
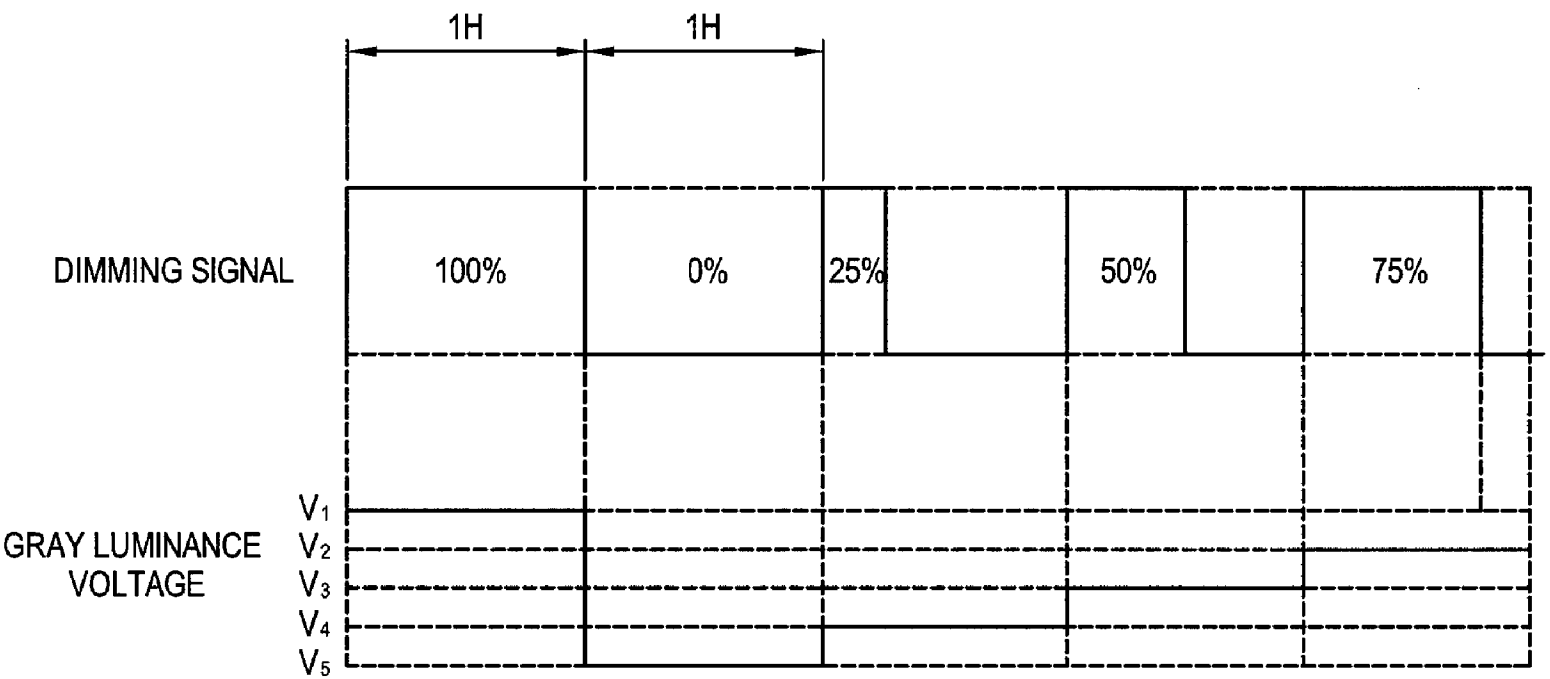
FIG. 6 is a waveform chart illustrating an exemplary embodiment of a dimming signal and a gray luminance voltage from an exemplary embodiment of a signal controller or a dimming signal converter, respectively, according to the present invention.

FIG. 6 is a waveform chart illustrating an exemplary embodiment of the dimming signal and the gray luminance voltage from an exemplary embodiment of the signal controller and the dimming signal converter, respectively, according to the present invention.

The variation ratios of the dimming signal and the gray luminance voltage are shown in FIG. 6. as shown, the gray luminance voltage corresponding to the 100% is higher than the gray luminance voltage corresponding to the 50%. For example, the voltages V1 and V3 of the gray luminance voltages correspond to the 100% and 50% dimming signal, respectively.

According to the embodiments of the present invention, the values of the common voltages are increased or decreased based on the average gray for one frame of an LCD for compensation of the variation of the kickback voltage depending on the gray. Therefore, the variation of the pixel voltage depending on the gray is decreased to improve image quality of the LCD.

The variable common reference voltage converter 720 includes a non-inverting amplifier AP0. The non-inverting amplifier AP0 includes a positive feedback operating amplifier including an input resistor R23. The positive feedback operating amplifier AP0 can further include resistors R21 and R22. The non-inverting terminal(+) of the operating amplifier AP0 is supplied with a input reference voltage (Virl), for example, 3 voltage, supplied from a power supply and a gray luminance voltage (Vglv), for example, 0~5 voltages, supplied from the B node, and the inverting terminal(−) thereof is connected to a ground. The gray luminance voltage and the input reference voltage are added. The non-inverting terminal receives the output signal of the dimming signal converter. The operating amplifier AP0 outputs a variable common reference voltage Vrcom1 through the output terminal thereof for application to the variable common voltage generator. In an exemplary embodiment, the operating amplifier AP0 can output variable common reference voltages Vrcom1-Vrcom4 respectively divided by resistors R24, R25 and R26 from the variable common reference voltage Vrcom1 at the output terminal.

The value of a variable common reference voltage Vrcom1 is determined by the resistance ratio of the resistors R21, R22 and R23, and for example, the variable common reference voltage Vrcom1 is given by the relation Vrcom1=(R23/R22)×Virv+(R23/R22)×Vglv. The variable common reference voltage converter 720 adjusts the voltages Vrcom1-Vrcom4 responsive to the adjusting values from the dimming signal converter 730. The variation of the voltages Vrcom1-Vrcom4 depends on the characteristics of the LCD. The resistors R24, R25 and R26 for the voltages Vrcom1-Vrcom4 may be set by a user or may be controlled according to a feedback voltage fed from the common electrode 270.

Figure 5:
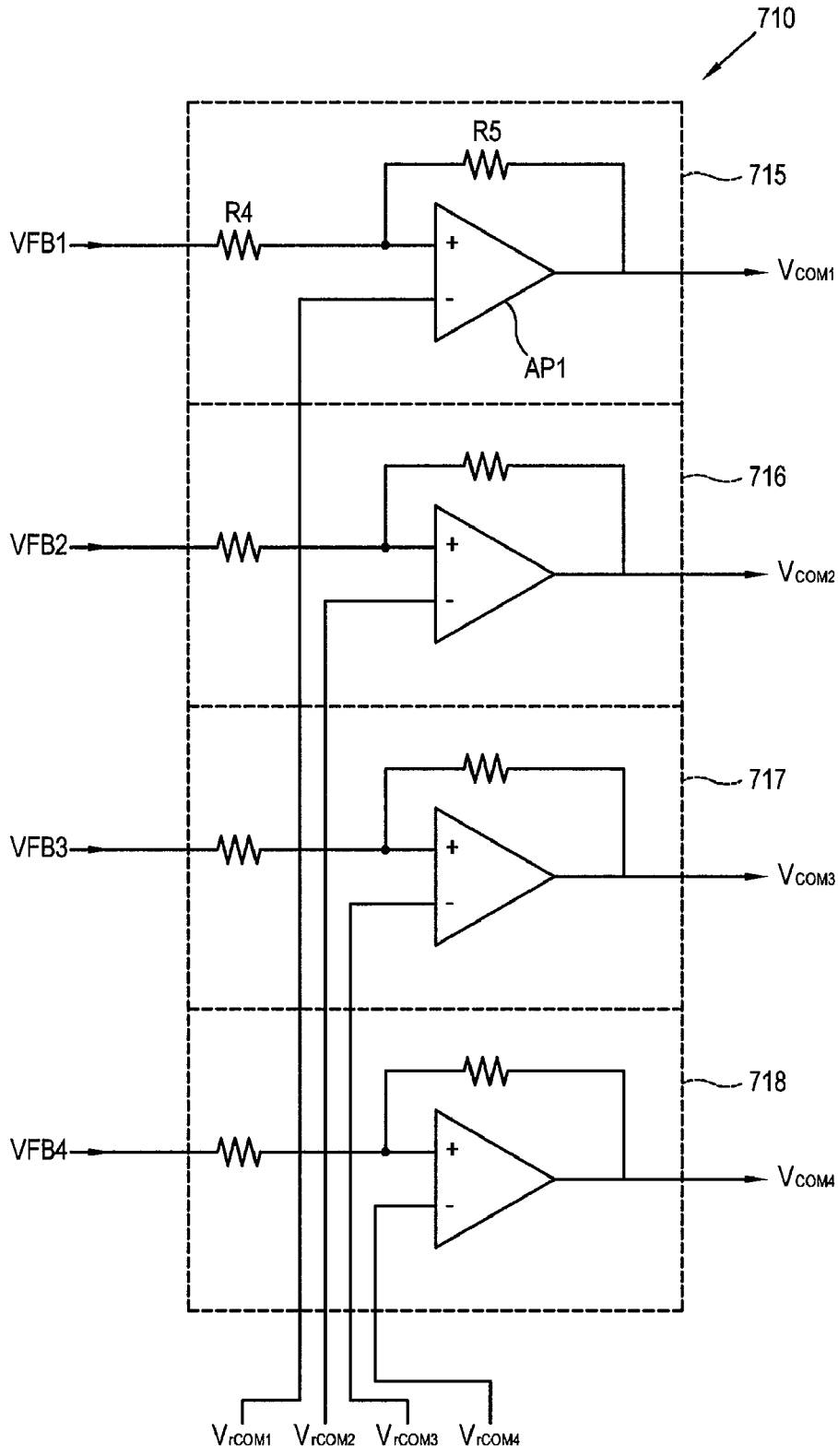
FIG. 5 is an equivalent circuit illustrating an exemplary embodiment of a variable common voltage generator of an exemplary embodiment of a common voltage generator illustrated in FIG. 1.

FIG. 5 is an equivalent circuit illustrating an exemplary embodiment of a variable common voltage generator 710 of an exemplary embodiment of a common voltage generator 700 illustrated in FIG. 1.

The variable common voltage generator 710 includes a plurality of, for example, four inverting amplifiers 715-718 respectively connected to the variable common reference voltage converter 720. The four inverting amplifiers 715-718 have substantially the same configuration, and for convenience, the configuration of one inverting amplifier 715 will be described in detail as an example. The inverting amplifier 715 includes a negative feedback operation amplifier AP1 including an input resistor R4 and a feedback resistor R5. The inverting terminal(−) of the operating amplifier API is supplied with a first feedback voltage VFB1, and the non-inverting terminal (+) thereof is connected to the variable common reference voltage converter 720 such that it receives the output signal of the variable common reference voltage converter 720. Here, the first feedback voltage is input from a one position of the common electrode 270, the second to the forth feedback voltage respectively are input from different positions of the common electrode 270. The operating amplifier AP1 outputs the first feedback voltage VFB1 to the common electrode 270 through an output electrode. The operation of the variable common voltage generator 710 having the above-described configuration will be described in detail.

The variable common reference voltage converter 720 supplies the variable common reference voltages Vrcom1-Vrcom4 to the respective operating amplifiers 715-718. Responsive to the common reference voltage Vrcom1-Vrcom4, each operating amplifier 715-718 generates a variable common voltage $V_{com1}$-$V_{com4}$ and outputs the variable common voltage $V_{com1}$-$V_{com4}$ to each position of the common electrode 270 corresponding to the first to the forth feedback voltage. Further, each operating amplifier 715-718 is supplied with a feedback voltage VFB1-VFB4, which is fed from the corresponding position of the common electrode 300.

The value of each variable common voltage $V_{com1}$-$V_{com4}$ is determined by the resistance ratio of the input resistor R4 and the feedback resistor R5, and for example, the variable common voltage $V_{com1}$ is given by the relation $V_{com1}$=(1+$R_5$/$R_4$)×VFB1−($R_5$/$R_4$)×$V_1$. Therefore, when a stable voltage is applied to the common electrode 300, $V_{com1}$=Vrcom1. As a result, Vrcom1-Vrcom4 from the variable common reference voltages converter 720 can be considered to be equal to the variable common voltage $V_{com1}$-$V_{com4}$. Consequently, each operating amplifier 715-718 removes noise components such as a peak component to make the variable common voltages $V_{com1}$-$V_{com4}$ stable, thereby preventing a cross-talk of signals due to the noise components. At this time, the values of the voltages Vrcom1-Vrcom4 are determined such that the flicker is most effectively prevented for the middle gray among the total gray, for example, the $128^{-th}$ gray among the total 256 grays.

If it is assumed that the pixel voltage across the LC capacitor $C_{LC}$ of a pixel is $V_p$, the data voltage and the common voltage applied to the LC capacitor $C_{LC}$ are $V_d$ and $V_{com}$, and the kickback voltage of the pixel is $V_k$, the pixel voltage $V_p$ is determined by:

$$V_p=(V_d-V_{com})-V_k=V_d-(V_{com}+V_k) \quad (1)$$

According to an embodiment of the present invention, $V_{com}$ is decreased or increased by an amount of increase or decrease of $V_k$ such that $(V_{com}+V_k)$ for each gray is uniform. For example, if $(V_{com}+V_k)$ is fixed to a constant C for the 32-nd gray among the total 64 grays, $(V_{com}+V_k)$ satisfies the relation $V_{com}+V_k=C=V_{com}(\mathbf{32})+V_k(\mathbf{32})$.

Therefore, the difference $(\Delta V_{com})$ between the common voltage for the 32-th gray and the common voltage for the average gray is given by:

$$\Delta V_{com}=V_{com}-V_{com}(32)=V_k(32)-V_k=-\Delta V_k. \quad (2)$$

Therefore, the common voltage may compensate the variation ratio of the kickback voltage.

Figure 7:
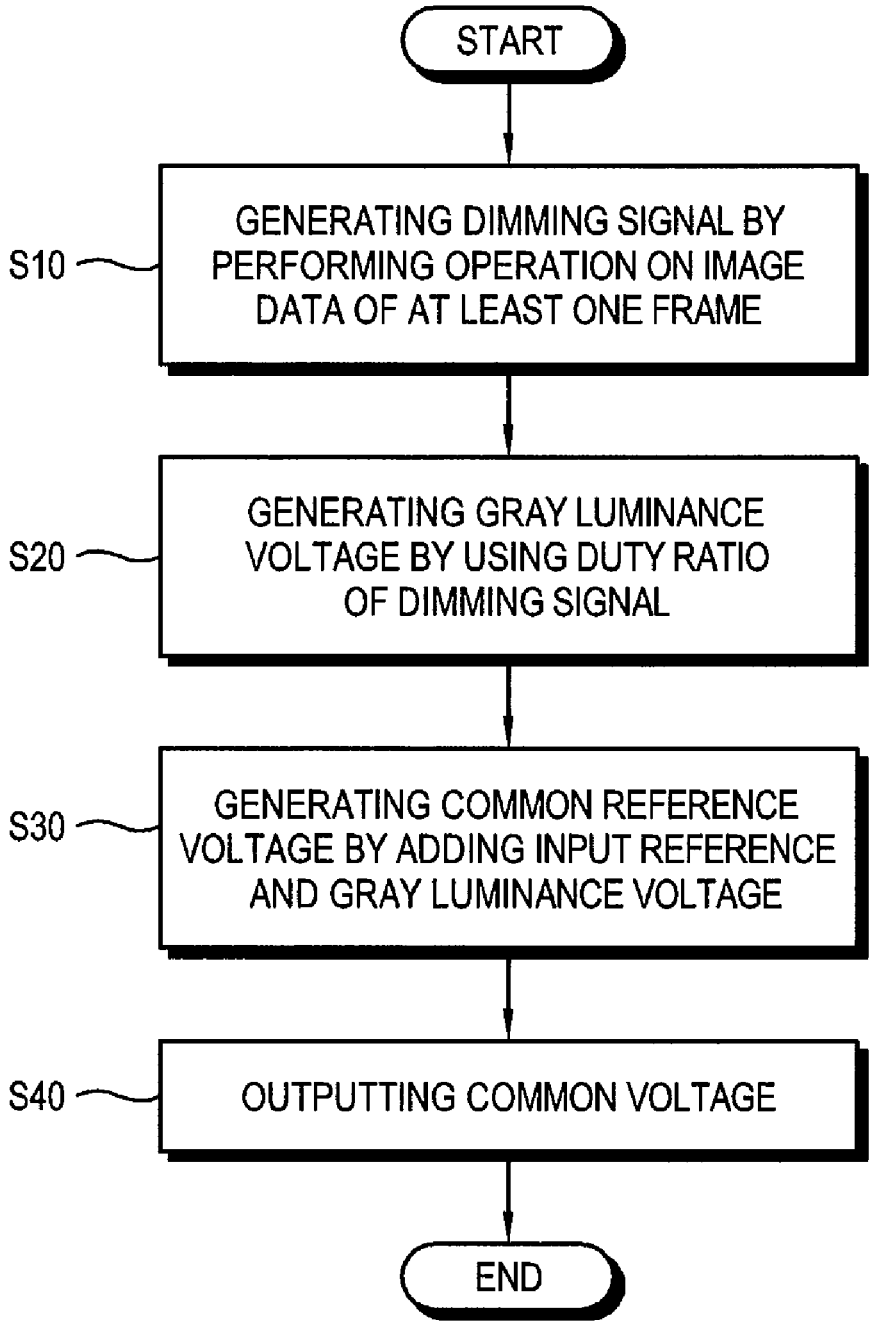
FIG. 7 is a flow chart illustrating an exemplary embodiment of a driving method of an exemplary embodiment of an LCD device according to the present invention.

FIG. 7 is a flow chart illustrating an exemplary embodiment of a driving method of an exemplary embodiment of an LCD device according to the present invention.

Referring to FIG. 7, an exemplary embodiment of a driving method of the LCD device includes the steps of creating of a dimming signal by performing operation on image data of at least one frame (S10), creating a gray luminance voltage by using a duty ratio of the dimming signal (S20), generating a common reference voltage by adding the input reference voltage and a gray luminance voltage (S30), and outputting a common voltage according to the common reference voltage to the LCD panel (S40).

Specifically, in step S10, if the externally supplied digital image data R, G and B are supplied to the dimming controller 610, the dimming controller 610 of the signal controller 600 generates the dimming signal by performing operations on image data during at least one frame. In one exemplary embodiment, the dimming controller 610 is a logic block of the FPGA installed in the signal controller 600. The dimming controller 610 stores the image data (R, G, B) and calculates the average gray of the image data R, G and B for one frame and supplies the dimming signal corresponding to the average gray of the R, G and B to the dimming signal converter 730. The dimming signal may be a pulse width modulation ("PWM") signal with a duty ratio. If the operation value is more than the reference value, the dimming controller 610 generates the dimming signal of a high level and if the operation value is less than the reference value, it generates the dimming signal of a low level.

In step S20, the dimming signal converter 730 receives and converters the dimming signal and supplies the gray luminance voltage (Vglv) to the variable common reference voltage converter 720.

In step S30, the variable common reference voltage converter 720 generates the common reference voltage by adding the input reference voltage and the gray luminance voltage. In one exemplary embodiment the variable common reference voltage converter 720 adjusts the variable common reference voltages Vrcom1-Vrcom4 responsive to the gray luminance voltage from the dimming signal converter 730. The variation of the variable common reference voltages Vrcom1-Vrcom4 depends on the characteristics of the LCD.

In step S40, the variable common voltage generator 710 outputs the variable common voltages $V_{com1}$-$V_{com4}$ through the output terminal thereof for application to the common electrode 300. The variable common voltages $V_{com1}$-$V_{com4}$ prevent a cross-talk of signals due to the noise components. At this time, the values of the voltages $V_{com1}$-$V_{com4}$ are determined such that the flicker is most effectively prevented for the middle gray among the total gray, for example, the $128^{-th}$ gray among the total 256 grays.

According to the LCD device and driving method thereof according to the present invention, the values of the common voltages are increased or decreased based on the average gray for one frame of an LCD for compensation of the variation of the kickback voltage depending on the gray. Therefore, the variation of the pixel voltage depending on the gray is decreased to improve image quality of the LCD.

Although preferred embodiments of the present invention have been described in detail hereinabove, it should be clearly understood that many variation and/or modifications of the basic inventive concept herein taught which may appear to those skilled in the present art will still fall within the spirit and scope of the present invention, as defined in the appended claims.

What is claimed is:

1. A liquid crystal display including a plurality of pixels, the display comprising:

a gray voltage generator generating a plurality of gray voltages;

a data driver in communication with the gray voltage generator, the data driver generating data voltages selected from the gray voltages corresponding to image data to be applied to the pixels;

a gate driver supplying gate voltages to gate lines of the pixels;

a signal controller in communication with the gate driver and the data driver, the signal controller supplying a first control signal to the gate driver and the image data and a second control signal for controlling the image data to the data driver;

a dimming controller generating a dimming signal based on an average gray of the image data; and a common voltage generator in communication with the dimming controller, the common voltage generator generating at least one common voltage based on the dimming signal and applying the common voltage to the pixels, wherein the dimming signal comprises a pulse width modulation (PWM) dimming signal having a variable duty ratio according to a comparison of a value of the average gray with a gray reference value, wherein the dimming controller comprises:

a frame memory storing the image data; and an average gray calculator calculating the average gray of the image data for at least one frame;

wherein the common voltage generator comprises:

a dimming signal converter that generates a gray luminance voltage by integrating the dimming signal;

a variable common reference voltage converter that outputs at least one common reference voltage by adding the gray luminance voltage and an input reference voltage from an external input; and a variable common voltage generator that outputs at least one variable common voltage based on the common reference voltage, and wherein the dimming signal converter comprises a bipolar transistor including a base electrode connected to the average gray calculator, a collector electrode (A node) connected to a supply voltage and an emitter electrode connected to a ground voltage.

2. The liquid crystal display of claim 1, wherein the at least one common voltage increases with the value of the average gray of the image data.

3. The liquid crystal display of claim 2, wherein the value of the average gray is an averaged value of the image data for at least one frame.

4. The liquid crystal display of claim 1, wherein the signal controller comprises the dimming controller.

5. The liquid crystal display of claim 1, wherein the dimming signal converter comprises a resistor connected between the supply voltage and the collector electrode.

6. The liquid crystal display of claim 1, wherein the variable common reference voltage converter comprises a negative feedback inverting amplifier including an inverting terminal connected to the ground, a non-inverting terminal receiving the gray luminance voltage and the input reference voltage connected to the gray luminance voltage in parallels and an output terminal outputting at least the common reference voltage.

7. The liquid crystal display of claim 6, wherein the variable common voltage generator comprises at least one negative feedback inverting amplifier including an inverting terminal connected to a feedback voltage corresponding to the common voltage applied to the pixel and a non-inverting terminal connected to the at least one common reference voltage.

8. The liquid crystal display of claim 1, wherein the dimming signal comprises a pulse width modulation (PWM) dimming signal having a variable duty ratio according to a comparison of a value of the average gray with a gray reference value.

9. The liquid crystal display of claim 8, wherein the PWM dimming signal has a high duty ratio if the value of the average gray is higher than the gray reference value or the PWM dimming signal has a low duty ratio if the value of the average gray is lower than the gray reference value.

* * * * *